United States Patent [19]

Grzina

[11] 4,113,407

[45] Sep. 12, 1978

[54] HIGH PRESSURE INTERNALLY LINED PUMP CASING

[75] Inventor: Anthony Grzina, Artarmon, Australia

[73] Assignee: Warman International Limited, Artarmon, Australia

[21] Appl. No.: 691,436

[22] Filed: Jun. 1, 1976

[30] Foreign Application Priority Data

Jun. 2, 1975 [AU] Australia ..... 1838/75

[51] Int. Cl.[2] ..... F04D 29/08; F04D 29/40; F03B 11/02; F01D 25/24

[52] U.S. Cl. ..... 415/170 R; 415/197; 415/219 C; 29/463; 220/400; 285/350

[58] Field of Search ..... 415/219 C, 174, 128, 415/196, 170 R, 170 A, 170 B, 112, 197; 277/212 FB, 214, 215, 172; 220/4 E, 4 B, 65, 63 R; 285/350, 55, DIG. 9, 373; 29/463

[56] References Cited

U.S. PATENT DOCUMENTS

| | | | |
|---|---|---|---|
| 440,798 | 11/1890 | Webbe | 415/219 C |
| 1,671,054 | 5/1928 | Welsh | 415/219 C |
| 1,912,408 | 6/1933 | Schelhammer | 415/112 X |
| 2,592,419 | 4/1952 | Harper et al. | 220/63 R X |
| 2,821,414 | 1/1958 | Jensen | 60/39.32 X |
| 2,944,785 | 7/1960 | Sampietro | 415/174 X |
| 3,683,421 | 8/1972 | Martinie | 277/212 FB X |

FOREIGN PATENT DOCUMENTS

| | | | |
|---|---|---|---|
| 527,392 | 7/1956 | Canada | 415/174 |
| 738,083 | 10/1955 | United Kingdom | 220/63 R |

*Primary Examiner*—Carlton R. Croyle
*Assistant Examiner*—Donald S. Holland
*Attorney, Agent, or Firm*—Haseltine, Lake & Waters

[57] ABSTRACT

A pump casing for high pressure pumps is composed of two halves each half being provided with a liner. The two casing halves are joined by flanges which are recessed to receive corresponding flanges of the liners. At least one groove is provided in the recess formed by the casing flanges to receive and retain part of the liner flange material.

3 Claims, 4 Drawing Figures

HIGH PRESSURE INTERNALLY LINED PUMP CASING

FIELD OF THE INVENTION

The invention relates to high pressure casings for centrifugal pumps, for example slurry pumps fitted with replaceable elastomeric liners and in particular but not exclusively to casings fitted with moulded rubber liners.

The invention is applicable to pump casings split along a center plane (normal to the axis of impeller rotation) to permit insertion of the liners, which are held in position by joining the casing halves.

BACKGROUND

In the case of single stage pumps split along a plane through the center line of the pump's discharge branch it is customary to split the liner in the same manner and to provide the two liner halves of elastomeric material with flanges protruding into a space between the two casing halves left for this purpose. When joining the two halves of the casing by bolts around the casing periphery the liner flanges are squeezed together to retain the liner halves in their correct position and at the same time to retain the fluid pressure within the pump casing without leakage.

In order to prevent an overtightening of the joints, metallic spacers may be provided between the casing halves to determine the maximum compression of the liner flanges.

The pressure sealing ability of these known arrangements is dependent on the hardness of the lining material and the amount of compression applied to the flanges of the liners at the casing joints.

These known arrangements have, however, certain disadvantages, when applied to slurry pumps operating with relatively high internal pressures. In such pumps used for abrasive slurries it is desirable to use liners made from relatively soft and pliable rubber, thereby providing the best wear resistance to the abrasive action of the slurry. It has been found that at high pressures these rubber liners will extrude between the casing halves regardless of the amount of compression applied to their flanges between the casing halves.

SUMMARY OF THE INVENTION

It is an object of this invention to provide a construction for split casings for centrifugal pumps, in particular slurry pumps, which will accommodate elastomeric replaceable liners in such a manner as to anchor said liners securely in order to contain fluid at high pressures within said casing without leakage and without undue distortion of said liners.

The above object is achieved according to the invention by a high pressure internally lined pump casing split in halves in a plane perpendicular to the axis of rotation of the pump shaft, wherein at least one of the mating faces of the casing halves is stepped to provide, when the halves are assembled, a recess receiving flanges of said liner halves, at least one groove being provided in said stepped face(s) to receive and retain liner flange material therein. The groove or grooves thus receive the material displaced from the flange of the liners when they are compressed by the clamping together of the casing halves without distorting the interior liner face. In one form of the invention, the two casing halves each have a flange at its outer periphery and are held together by a number of bolts and nuts suitably located around the periphery of said halves, the flanges having machined mating faces which bear tightly one against the other when the casing halves are drawn together by the bolts and nuts.

Either or both of these mating faces are stepped inwardly, so that when the two casing halves are assembled, the stepped parts of the mating faces form a cavity or recess inside the casing while the outer parts of the mating faces abut each other over their whole surface. The casing halves are provided with liners of elastomeric material, each having outwardly extending flanges of a thickness slightly more than half the width of the recess between the casing halves, so that the flanges are compressed when the casing halves are bolted together.

Either or both of the faces of the mating casing flanges, which form the recess accommodating the liner flanges, have a circumferential groove at the outer extremity of the recess so arranged that the material displaced from the liner flanges, when said flanges are compressed by clamping of the casing halves, will flow into said groove or grooves. The dimensions and configuration of the liner flanges, the recess and the groove(s) are chosen so that after final assembly, and clamping of the casing halves with the outer portion of their mating flanges hard against one another, the liner material completely fills the recess and groove(s). Such an arrangement allows the liner flanges to be compressed without causing displaced liner flange material to flow inwards and distort the internal configuration of the liners. In addition, the recess and groove arrangement according to this invention anchors the liners securely to the casing in the flange area.

The arrangement of the casing and liners is such that the liner material is fully contained and cannot be extruded through the casing joint by internal fluid pressure. The arrangement thereby provides a construction which is suitable for high operating pressures and even in large pumps (12,000 GPM or greater) pressures in excess of 500 P.S.I. can be contained in casings fitted with replaceable elastomeric liners.

Although particularly advantageous in connection with liners of comparatively soft and pliable material, the invention can be used also in connection with liners of harder material and in some cases it may be advisable to provide the liner flanges with a bead entering the aforementioned groove.

BRIEF DESCRIPTION OF THE DRAWINGS

The invention will now be described in more detail by way of example in relation to the accompanying drawings which show two embodiments of the invention.

DETAILED DESCRIPTION

Figure 1:
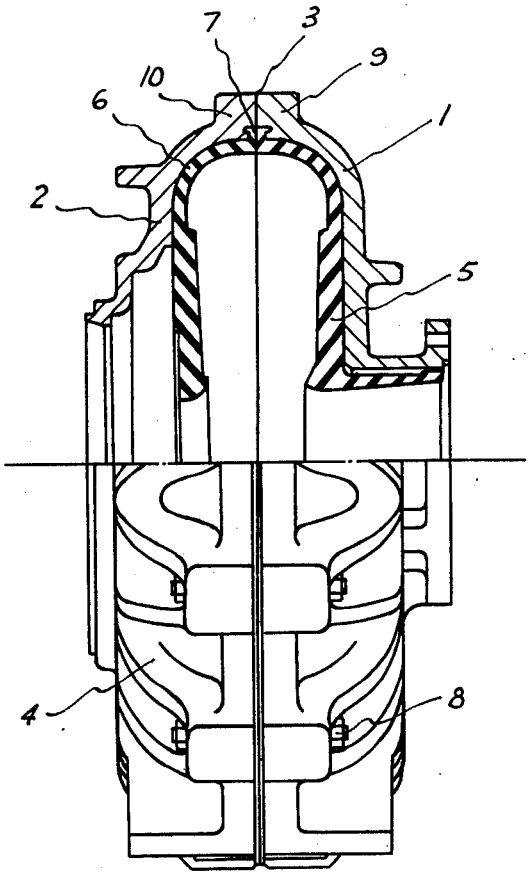
FIG. 1 is a cross-section of a centrifugal slurry pump having split casing halves with joined flanges and rubber liners, according to the invention.

Referring to FIG. 1 a pump casing 4 is split along center line 3 into two casing halves 1 and 2 referred to hereinafter as the cover plate and the frame plate respectively which contain moulded rubber liners consisting of two main portions, namely cover plate liner 5 and frame plate liner 6. The cover plate liner 5 and frame plate liner 6 are provided with flanges 7 around their periphery which are clamped and contained in a recess in the cover plate 1 and frame plate 2, when they are clamped together by bolts 8, arranged in the casing flanges 9 and 10 around the circumference of the casing 4.

Figure 2:
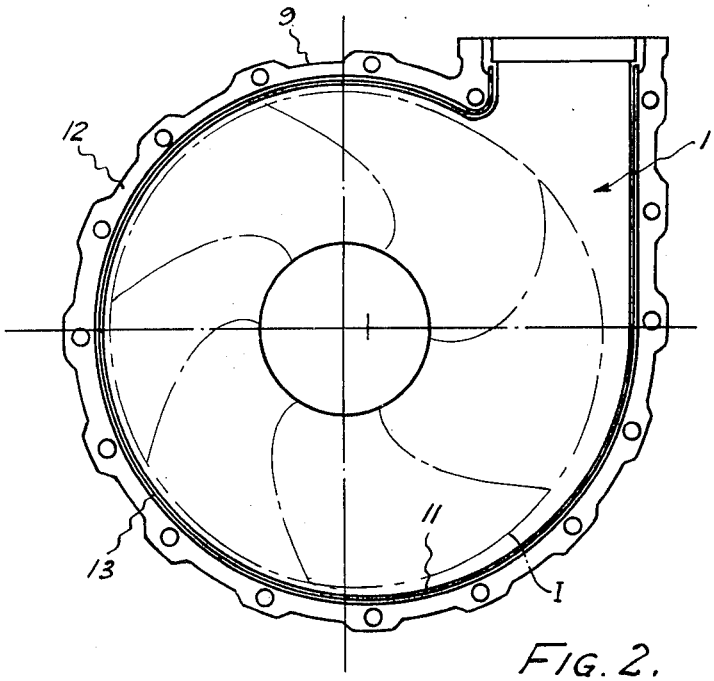
FIG. 2 is an internal view of one half of the pump casing according to this invention showing the recess and groove extending around the periphery.

FIG. 2 is an internal view of the cover plate 1 showing the face of the flange 9 around the periphery. An impeller I of the pump is illustrated in the casing 4 in chain dotted lines. The outer portion 12 of the flange 9 is a plane surface which will mate hard against the corresponding face of the flange of the other casing half or frame plate 2 when the pump is assembled.

The remainder of the flange face is stepped down so that an internal recess 11 (FIG. 3) is formed when the two casing halves are bolted together. A groove 13 is provided at the outer edge of the stepped face or recess 11 as shown in more detail in FIGS. 3 and 4.

Figure 3:
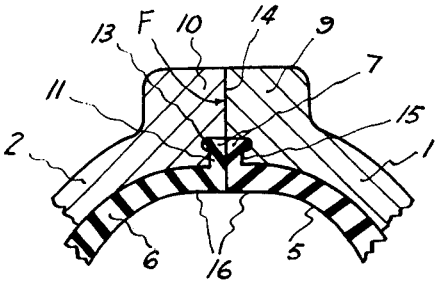
FIG. 3 is an enlarged cross-section of a portion of the joined casing flanges showing details of symmetrically arranged recesses and grooves to secure rubber liner flanges between them.

In FIG. 3 details of the flanges 9 and 10 of the coverplate 1 and frame plate 2 are shown. The mating faces F of the casing flanges have an outer portion 14 which is machined flat and an inner portion 15 which is stepped down, together forming a cavity or recess 11 to accommodate the flanges 7 of the rubber liners 5 and 6.

At the outer extremity of the stepped faces 15 of the casing halves 1 and 2, undercut grooves 13 are provided. When the cover plate 1 and the frame plate 2 are drawn together the flanges 7 of the rubber liners 5 and 6 are compressed between the faces 15 of the casing flanges 9 and 10.

When assembly of the casing is complete and faces 14 bear hard against one another displaced rubber from the liner flanges 7 completely fills the grooves 13.

The recess and grooves are designed to provide sufficient space for the rubber displaced from the flanges 7 thus preventing flow of displaced rubber toward the interior of the pump casing which could cause distortion of the interior faces 16 of the liners 5 and 6.

Figure 4:
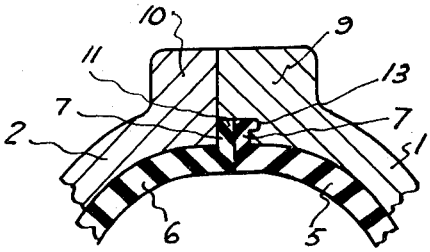
FIG. 4 is an enlarged cross-section of a portion of the joined casing flanges showing details of a recess and groove for an asymetrical arrangement.

While FIG. 3 shows a symmetrical arrangement of the recess and grooves in both casing halves, FIG. 4 shows an arrangement wherein a recess 11 is provided in flange 9 only and one corresponding groove 13 only is provided to accommodate rubber displaced from both liner flanges 7 when flanges 9 and 10 are clamped together. In a modification of this latter arrangement, an additional groove may be provided in the casing flange 10.

In the embodiments shown in the drawings, the groove or grooves have a semicircular cross-section but it must be understood that grooves of other cross-sectional shapes may be employed.

I claim:

1. A high pressure internally lined pump casing adapted to receive an impeller and split in halves in a plane substantially perpendicular to an axis of rotation of the impeller, said casing halves including flanges with mating faces around the peripheries of said flanges, said mating faces being stepped, two liner halves of elastomeric material having flanges extending into the stepped mating faces, each of said stepped faces having a circumferential undercut groove therein and clamping means at the circumference of said faces for clamping said casing flanges together to displace material from said liner flanges into said grooves.

2. A pump casing as claimed in claim 1 wherein said liner halves are initially shaped to leave said undercut grooves empty, said grooves being filled with elastomeric material displaced from said liner flanges after clamping of the casing flanges by said clamping means, said grooves being dimensioned to constitute a space means of sufficient size for receiving the elastomeric material displaced from the liner flanges and preventing flow of elastomeric material inwardly thereby preventing distortion at the interior surfaces of the liners.

3. A pump casing as claimed in claim 2 wherein said casing halves and liner halves are split along a common longitudinal plane.

* * * * *